US010260508B2

(12) United States Patent
Chang et al.

(10) Patent No.: US 10,260,508 B2
(45) Date of Patent: Apr. 16, 2019

(54) FAN STRUCTURE WITH NON-CIRCULAR CIRCUMFERENCE

(71) Applicant: ASIA VITAL COMPONENTS CO., LTD., New Taipei (TW)

(72) Inventors: Bor-Haw Chang, New Taipei (TW); Yu-Tzu Chen, New Taipei (TW); Chung-Shu Wang, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 245 days.

(21) Appl. No.: 15/368,698

(22) Filed: Dec. 5, 2016

(65) Prior Publication Data

US 2018/0156231 A1 Jun. 7, 2018

(51) Int. Cl.
*F04D 19/00* (2006.01)
*F04D 33/00* (2006.01)

(52) U.S. Cl.
CPC ..... *F04D 19/002* (2013.01); *F04D 19/00* (2013.01); *F04D 33/00* (2013.01)

(58) Field of Classification Search
CPC ..... F04D 19/002; F04D 25/02; F04D 25/022; F04D 25/08; F04D 29/325; F04D 19/00; F04D 23/005; F04D 25/06; F04D 39/34; F04D 19/048; F16C 2326/58
USPC ..... 415/60, 5; 416/7, 8; 417/320, 352
See application file for complete search history.

(56) References Cited

U.S. PATENT DOCUMENTS 979,320 A * 12/1910 McKague et al. ..... F03B 7/006 415/5
2,415,592 A * 2/1947 Hoenecke ..... B65G 19/14 198/643
2,548,615 A * 4/1951 Petr, Jr. ..... F04D 33/00 416/8
2,553,001 A * 5/1951 Petr, Jr. ..... F04D 33/00 415/5
3,270,805 A * 9/1966 Glucksman ..... F04D 33/00 165/122

(Continued)

FOREIGN PATENT DOCUMENTS

CN 202833236 U 3/2013
CN 105443431 A 3/2016

(Continued)

*Primary Examiner* — Jason D Shanske
*Assistant Examiner* — Hakeem M Abdellaoui
(74) *Attorney, Agent, or Firm* — C. G. Mersereau DeWitt LLP

(57) ABSTRACT

A fan structure with non-circular circumference includes a frame, a first hub, a second hub, a transmission belt member, a first assembling member and a second assembling member. A first and a second base are provided in and protruded from a bottom of the frame. The first and the second hub are respectively mounted on the first and the second base, and a stator unit is provided between the first hub and the first base. The transmission belt member is fitted around side walls of the first and second hubs, and has a plurality of blades spaced on an outer surface thereof. The first and the second assembling member are correspondingly assembled to the tops of the first and the second hub. With the above arrangements, the fan structure can operate with largely reduced vibration and noise and can be manufactured at reduced material and production costs.

11 Claims, 6 Drawing Sheets

(56) References Cited

U.S. PATENT DOCUMENTS

| | | | | | |
|---|---|---|---|---|---|
| 3,992,125 | A * | 11/1976 | Schilling | F03B 17/068 415/5 |
| 4,049,300 | A * | 9/1977 | Schneider | F03D 3/04 290/54 |
| 4,186,314 | A * | 1/1980 | Diggs | F03D 5/02 290/44 |
| 6,435,827 | B1 * | 8/2002 | Steiner | B63H 1/34 415/5 |
| 7,744,340 | B2 * | 6/2010 | Levin | F04D 33/00 415/5 |
| 2015/0275906 | A1 * | 10/2015 | Yeh | H05K 3/105 417/410.1 |

FOREIGN PATENT DOCUMENTS

| | | | |
|---|---|---|---|
| CN | 105485052 | A | 4/2016 |
| JP | 08-019920 | A | 1/1996 |
| JP | 2006077612 | A | 3/2006 |

* cited by examiner

FAN STRUCTURE WITH NON-CIRCULAR CIRCUMFERENCE

FIELD OF THE INVENTION

The present invention relates to a fan structure with non-circular circumference, and more particularly, to a fan structure with non-circular circumference that can operate with largely reduced vibration and noise and can be manufactured at reduced material and production costs.

BACKGROUND OF THE INVENTION

With the constant progress of scientific technology, people's reliance on various kinds of electronic apparatuses also increases. Electronic products, such as computers and notebook computers, have internal elements that tend to produce a high amount of heat during operation thereof. The produced heat must be timely removed from the electronic products to avoid the problem of overheating. Therefore, most electronic products are internally equipped with a fan, so that the electronic products in operation can always maintain at a temperature within the working temperature range set for them.

FIG. 1 shows a conventional parallel fan structure 1 that includes two or more fan frames 10. The fan frames 10 are parallelly arranged side by side to contact with one another. When a fan operates, the motor thereof will inevitably produce vibration as a result of the torque of the motor. For the parallel fan structure 1 that includes two or more parallelly arranged fans, the produced vibration is increased. While the conventional parallel fan structure 1 can produce increased airflow to carry more heat away from the interior of the electronic product, the frames 10 of the parallelly connected fans in the parallel fan structure 1 also produce serious resonance effect when all the fans operate at the same time, this is because the vibration base-frequency of the fan wheels 11 will mutually influence on one another. In addition, the parallel fan structure 1 is subjected to serious dipole noise generation due to dipole-dipole interaction between fans arranged in pairs.

Accordingly, the conventional parallel fan structure has the following disadvantages: (1) the fans thereof produce increased vibration when they operate; and (2) it produces serious noise due to dipole-dipole interaction.

It is therefore tried by the inventor of the present invention to develop an improved fan structure that can eliminate the problems in the conventional parallel fan structure.

SUMMARY OF THE INVENTION

A primary object of the present invention is to effectively solve the aforesaid problems by providing a fan structure with non-circular circumference that can operate with largely reduced vibration.

Another object of the present invention is to provide a fan structure with non-circular circumference that can suppress noise produced due to dipole-dipole interaction.

A further object of the present invention is to provide a fan structure with non-circular circumference that can be manufactured at largely reduced material and production costs.

To achieve the above and other objects, the fan structure with non-circular circumference provided according to an embodiment of the present invention includes a frame, a first hub, a second hub, a transmission belt member, a first assembling member and a second assembling member. The frame internally defines a receiving space and has a first and a second base protruded from a bottom of the frame. The first hub is correspondingly mounted on the first base and includes a first top and a first side wall, and the first top is formed with a first engaging section. And, a stator unit is provided between the first hub and the first base. The second hub is correspondingly mounted on the second base and includes a second top and a second side wall, and the second top is formed with a second engaging section. The transmission belt member is fitted around the first and the second side wall and has a plurality of blades spaced on a surface portion thereof. The first and the second assembling member are correspondingly assembled to the first and the second top, respectively.

When the fan structure of the present invention operates, the first hub is first driven to rotate. The rotation of the first hub will bring the transmission belt member to rotate counterclockwise or clockwise. Meanwhile, the second hub is also brought by the transmission belt member to rotate along with the first hub. At this point, due to a pressure difference between upper and lower surfaces of the blades on the transmission belt member, air at an air inlet of the frame is sucked into the receiving space in the frame and then flows out of the frame via an air outlet. By causing the transmission belt member to rotate continuously along a noncircular circumferential path to enable the operation of the fan structure, it is able to overcome the problem of serious resonance between fan frames of the conventional parallel fan structure caused by the mutually influenced vibration base-frequency of the parallelly connected fans. Moreover, since the transmission belt member of the fan structure according to the present invention operates along a non-circular circumferential path, it is able to suppress dipole noise generation and accordingly minimize the noise produced due to dipole-dipole interaction. In addition, with the present invention, it is able to save the costs for some parts, such as one stator unit and one magnetic element, which are considered necessary in the conventional parallel fan structure.

Therefore, the fan structure of the present invention can be manufactured at largely reduced material and production costs.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
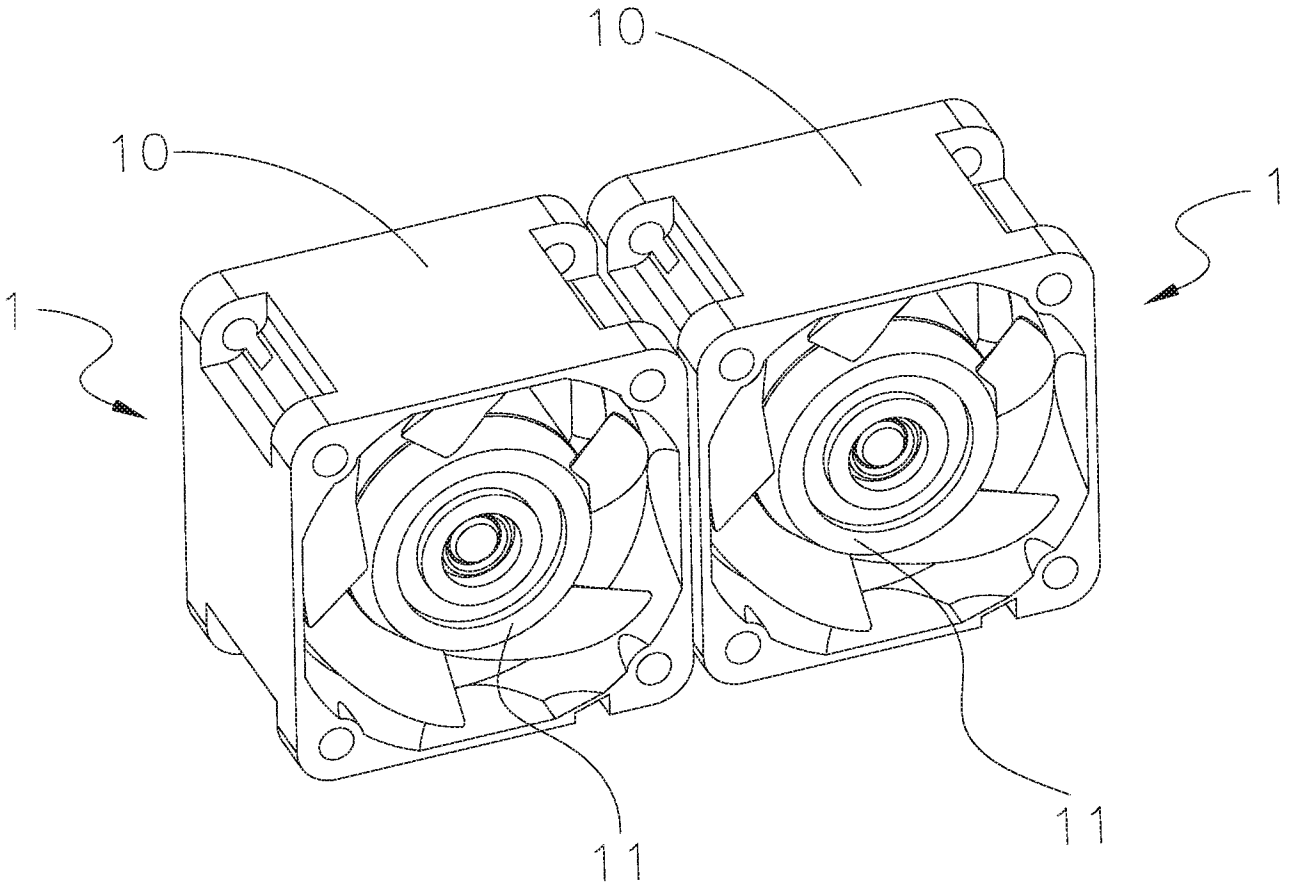
(prior art) Fig. 1
FIG. 1 is an assembled perspective view showing a conventional parallel fan structure.

The present invention will now be described with some preferred embodiments thereof and by referring to the accompanying drawings. For the purpose of easy to understand, elements that are the same in the preferred embodiments are denoted by the same reference numerals.

Figure 2:
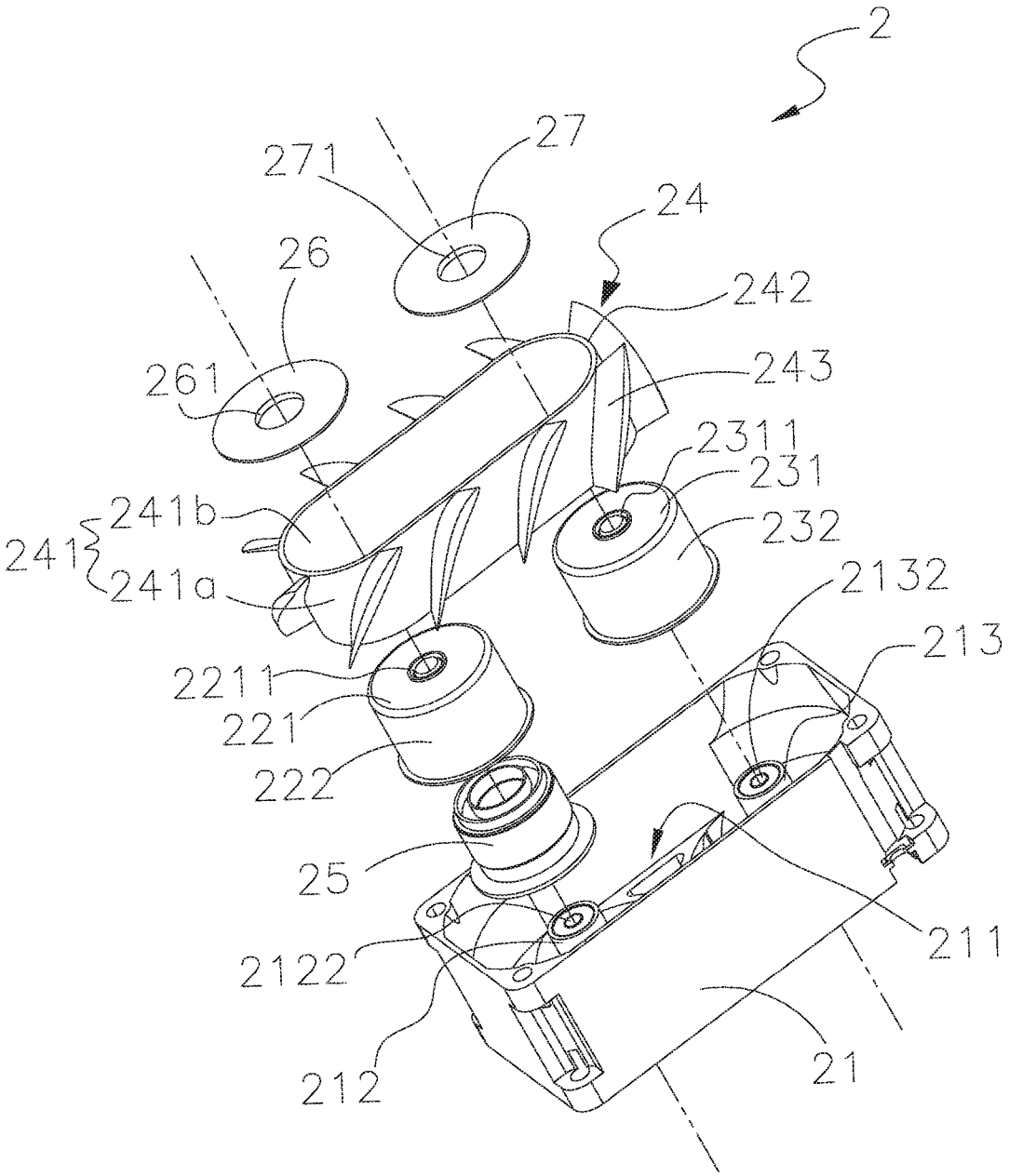
FIG. 2 is an exploded perspective view of a fan structure with non-circular circumference according to a first embodiment of the present invention.
Figure 3:
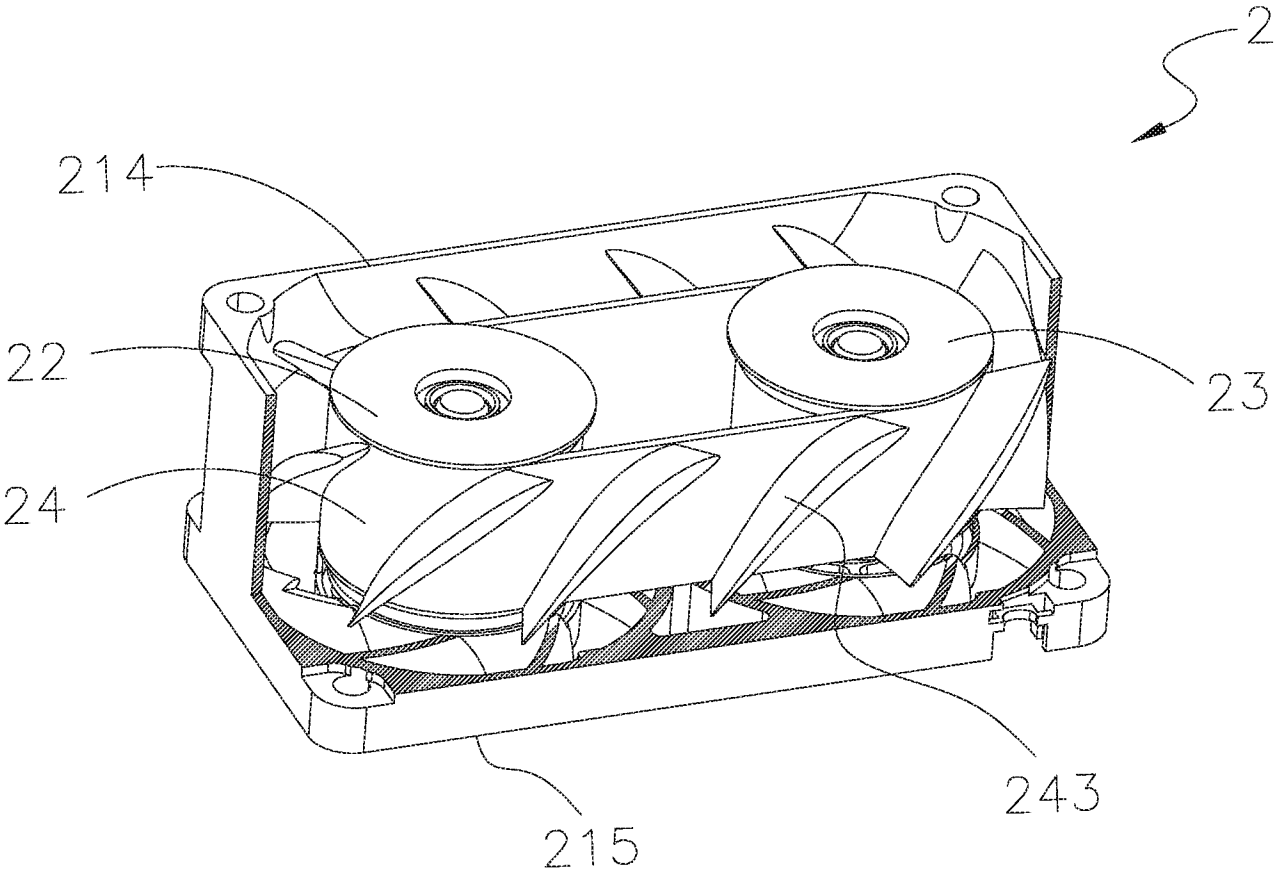
FIG. 3 is a cutaway view of the fan structure with non-circular circumference according to the first embodiment of the present invention.
Figure 4:
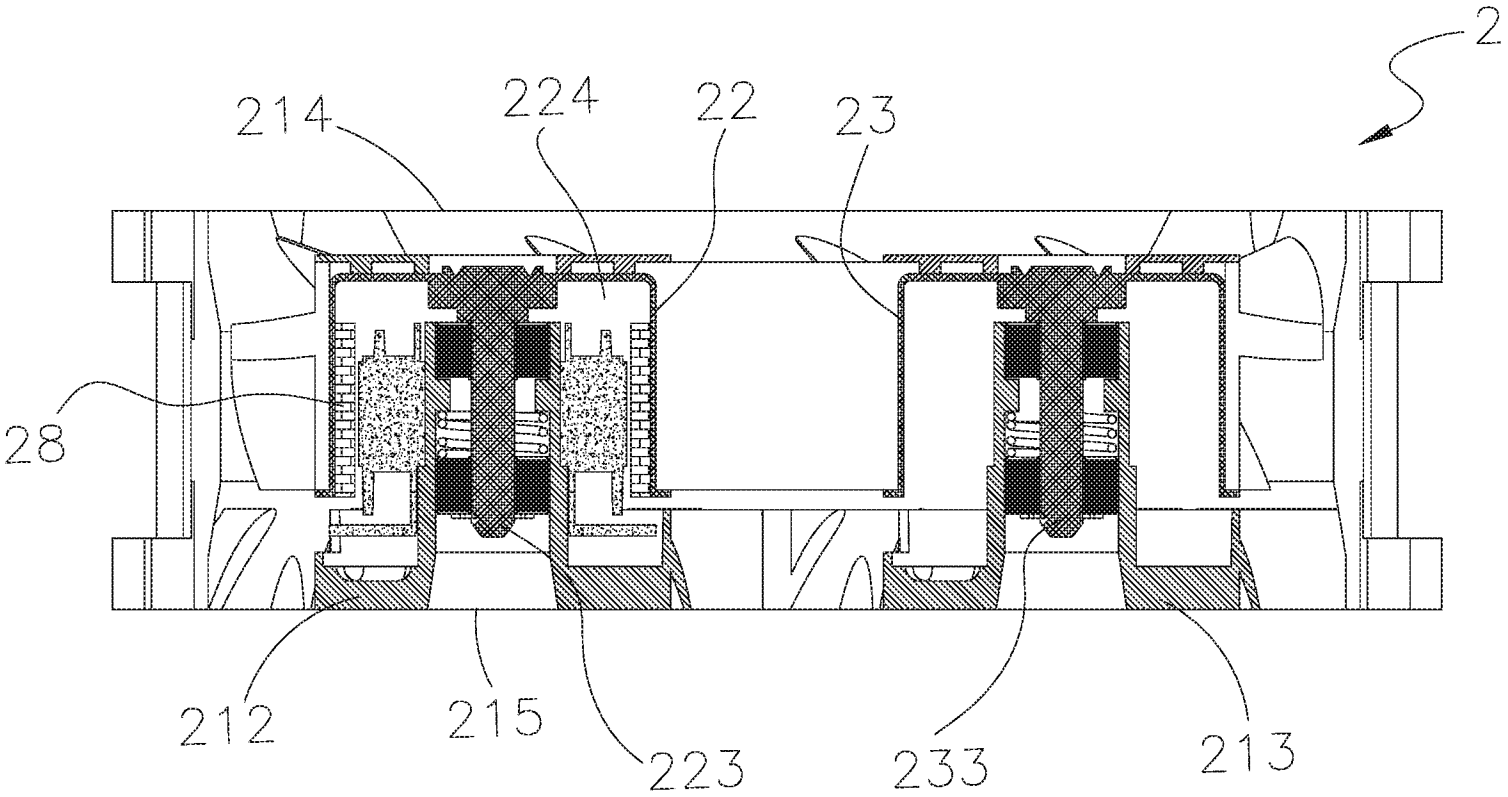
FIG. 4 is an assembled sectional view of the fan structure with non-circular circumference according to the first embodiment of the present invention.
Figure 5:
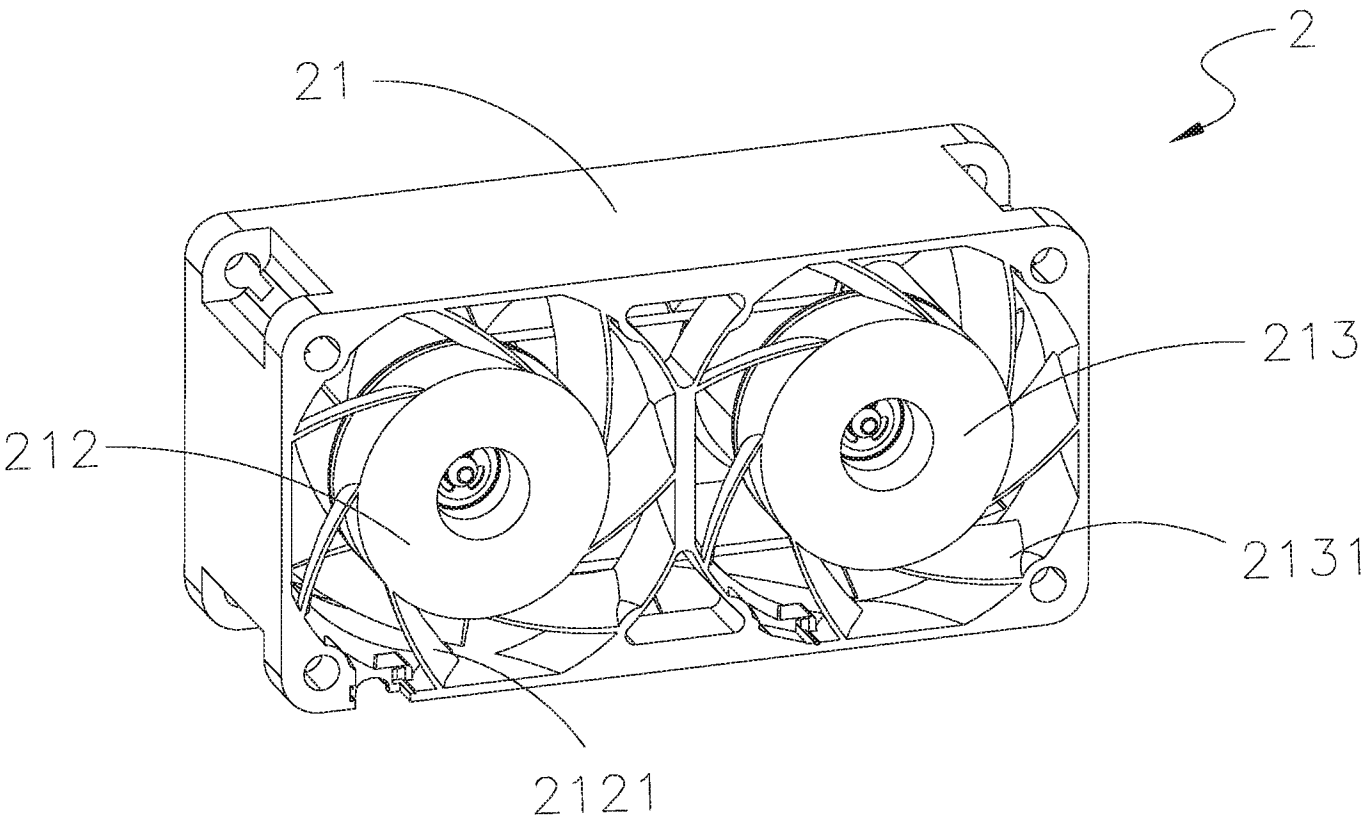
FIG. 5 is an assembled bottom view of the fan structure with non-circular circumference according to the first embodiment of the present invention.

Please refer to FIG. 2, which is an exploded perspective view of a fan structure with non-circular circumference according to a first embodiment of the present invention, and to FIGS. 3 to 5, which are cutaway view, assembled sectional view and assembled bottom view, respectively, of the fan structure with non-circular circumference according to the first embodiment of the present invention. For the purpose of conciseness and clarity, the present invention is also briefly referred to as the fan structure and generally denoted by reference number 2 herein. As shown, the fan structure 2 according to the first embodiment includes a frame 21, a first hub 22, a second hub 23, a transmission belt member 24, a first washer-shaped assembling member 26 and a second washer-shaped assembling member 27. The frame 21 internally defines a receiving space 211, an air inlet 214 and air outlet 215. The receiving space 211 is communicable with the air inlet 214 and the air outlet 215. In the frame 21, there are provided a first base member 212 and a second base member 213, which are protruded upward in a direction from the air outlet 215 toward the air inlet 214. The first base member 212 has a first shaft hole 2122 and is provided around a lower portion with a plurality of spaced first supporting arms 2121, which are outward extended to connect to the frame 21. The second base member 213 has a second shaft hole 2132 and is provided around a lower portion with a plurality of spaced second supporting anus 2131, which are outward extended to connect to the frame 21. Depending on user requirements, the first and the second supporting arms 2121, 2131 can be configured as a stationary vane airfoil structure, as shown in FIG. 5, or a rib structure (not shown), which can similarly achieve the intended effects of the present invention. Further, in the first embodiment, the frame 21 is an integrally formed structure and can be made of a metal material or a polymeric material.

The first hub 22 has a first shaft 223 being correspondingly inserted in the first shaft hole 2122 of the first base member 212. The first hub 22 also has a first top 221 and a first side wall 222, which together define a receiving chamber 224 in the first hub 22. The first top 221 is formed with a first engaging section opening 2211, and the receiving chamber 224 is communicable with the receiving space 211. A stator unit 25 is received in the receiving chamber 224 and fitted on the first base member 212. A magnetic element 28 is circumferentially provided on an inner surface of the first side wall 222 of the first hub 22 to be located corresponding to the stator unit 25. The magnetic element 28 and the stator unit 25 cooperate to enable excitation thereof.

The second hub 23 has a second shaft 233 being correspondingly inserted in the second shaft hole 2132 of the second base member 213. The second hub 23 also has a second top 231 and a second side wall 232. The second top 231 is formed with a second engaging section opening 2311.

The transmission belt member 24 is fitted around the first and the second side wall 222, 232 and has a belt surface portion 241 and an edge portion 242. The belt surface portion 241 includes an outer surface 241*a* and an inner surface 241*b*. On the outer surface 241*a*, there are provided a plurality of spaced blades 243. The inner surface 241*b* is in contact with the first and the second side wall 222, 232. Depending on user requirements, the blades 243 can be odd or even in number to similarly achieve the intended effects of the present invention. In the first embodiment, the blades 243 are integrally formed with the transmission belt member 24. The blades 243 can be made of any environment-friendly and nontoxic material with some desirable physical properties, such as good toughness, anti-slip ability and thermal stability. An example of this kind of material is silicone.

The first washer-shaped assembling member 26 has a first assembling section 261, which is correspondingly engaged with the first engaging section opening 2211 on the first top 221 of the first hub 22. The washer-shaped second assembling member 27 has a second assembling section 271, which is correspondingly engaged with the second engaging section opening 2311 on the second top 231 of the second huh 23. The first and the second washer-shaped assembling members 26, 27 are pressed against the edge portion 242 of the transmission belt member 24, lest the latter should become loosened or separated from the first and the second hub 22, 23 when the fan structure 2 operates.

When the fan structure 2 with the above-described arrangements starts operating, the stator unit 25 and the magnetic element 28 are excited to drive the first hub 22 to rotate. The rotation of the first hub 22 will bring the transmission belt member 24 to rotate counterclockwise or clockwise. Meanwhile, the second hub 23 is also brought by the transmission belt member 24 to rotate along with the first hub 22. At this point, due to a pressure difference between upper and lower surfaces of the blades 243 on the transmission belt member 24, air at the air inlet 214 of the frame 21 is sucked into the receiving space 211 in the frame 21 and then flows out of the frame 21 via the air outlet 215. By causing the transmission belt member 24 to rotate continuously along a noncircular circumferential path to enable the operation of the fan structure 2, it is able to overcome the problem of serious resonance between fan frames of the conventional parallel fan structure caused by the mutually influenced vibration base-frequency of the parallelly connected fans. Moreover, with the present invention, the first and the second hub 22, 23 are mounted in one single frame 21, and the stator unit 25 is provided only in the receiving chamber 224 of the first hub 22 while the first and second hubs 22, 23 are brought to rotate at the same time. Therefore, the fan structure 2 can operate with largely reduced vibration to suppress dipole noise generation and accordingly minimize the noise produced due to dipole-dipole interaction. In addition, with the present invention, it is able to save the costs for some parts, such as one stator unit and one magnetic element, which are considered necessary in the conventional parallel fan structures. Therefore, the fan structure 2 of the present invention can be manufactured at largely reduced material and production costs.

Figure 6:
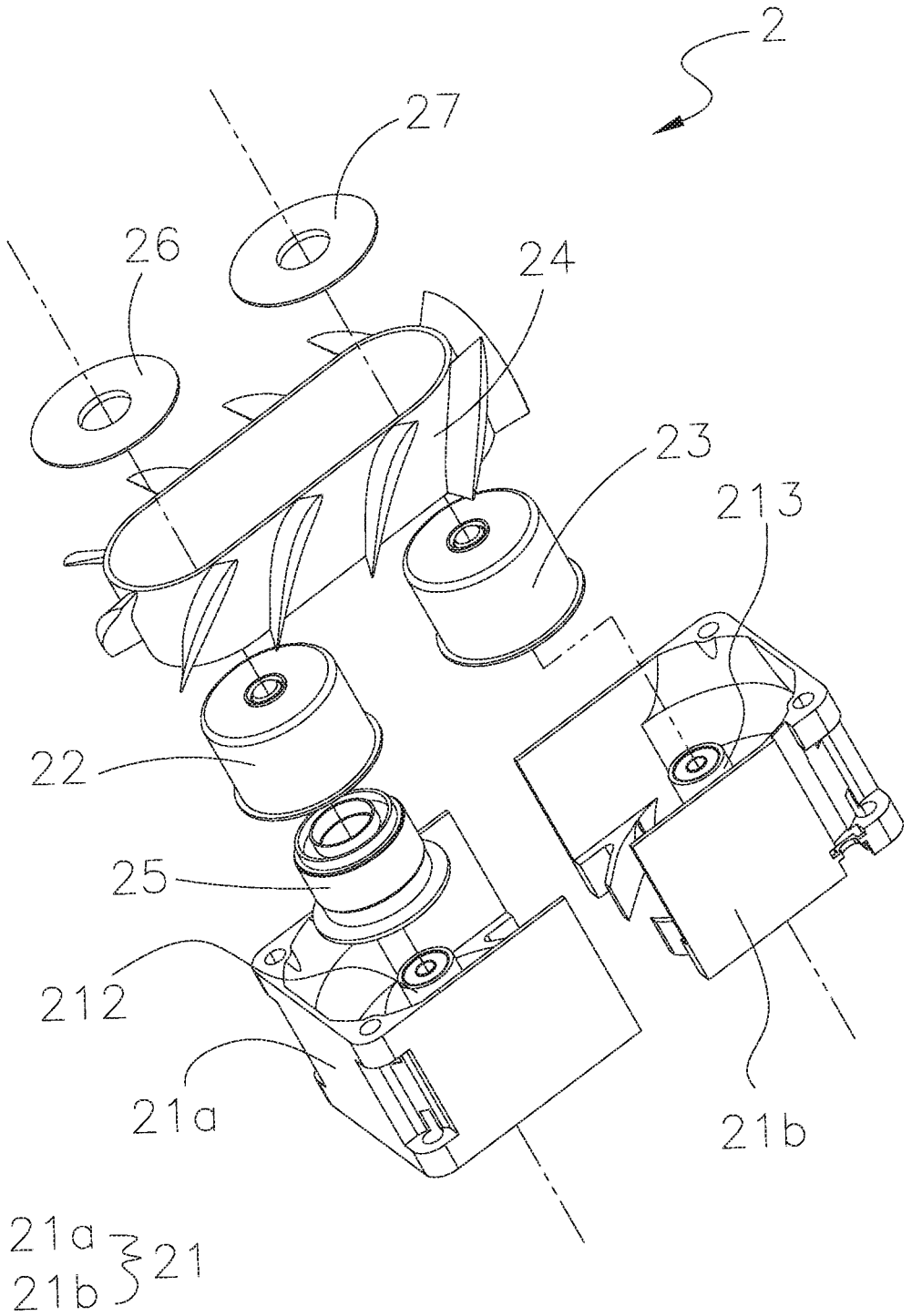
FIG. 6 is an exploded perspective view of a fan structure with non-circular circumference according to a second embodiment of the present invention.

Please refer to FIG. 6, which is an exploded perspective view of a fan structure with non-circular circumference according to a second embodiment of the present invention. The fan structure 2 in the second embodiment is generally structurally similar to the first embodiment, except that the frame 21 in the second embodiment is assembled from a first frame 21*a* and a second frame 21*b*. In other words, unlike the first embodiment, the frame 21 in the second embodiment is not integrally formed but includes a first and a second frame 21*a*, 21*b* that are assembled to each other by way of snap-fitting, gluing, bonding or fastening. In the second embodiment, the first base 212 is provided in the first frame 21*a* while the second base 213 is provided in the second frame 21*b*. With these arrangements, the fan structure 2 according to the second embodiment of the present invention can achieve the same effects as the fan structure 2 according to the first embodiment.

In summary, compared to the conventional parallel fan structures, the fan structure of the present invention has the following advantages: (1) it can operate with largely reduced vibration; (2) it largely suppresses the noise produced due to dipole-dipole interaction; and (3) it can be manufactured at largely reduced material and production costs.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan structure with non-circular circumference, comprising:

a frame internally defining a receiving space, in which a first base member and a second base member are mounted to protrude upward from a bottom of the frame;

a first hub being correspondingly mounted on the first base member, The first hub having a first top and a first side wall; the first top being formed with a first engaging section opening: and a stator unit is provided between the first hub and the first base;

a second hub being correspondingly mounted on the second base member, the second hub having a second top and a second side wall; and the second top being formed with a second engaging opening;

a transmission belt member being fitted around the first and the second side wall of the first and second hub and having a belt surface portion; and a plurality of blades being spaced on the surface portion;

a washer-shaped first assembling member being correspondingly assembled to the first top and having a first assembling section opening for correspondingly engaging with the first engaging section opening; and a washer-shaped second assembling member being correspondingly assembled to the second top and having a second assembling section opening for correspondingly engaging with the second engaging section opening.

2. The fan structure with non-circular circumference as claimed in claim 1, wherein the frame can be any one of an integrally formed frame and a non-integrally formed frame assembled from a first frame and a second frame.

3. The fan structure with non-circular circumference as claimed in claim 2, wherein the first frame and the second frame are assembled to each other in a way selected from the group consisting of snap-fitting, gluing, bonding, and fastening.

4. The fan structure with non-circular circumference as claimed in claim 1, wherein the first base has a first shaft hole, the second base has a second shaft hole, the first hub has a first shaft, and the second hub has a second shaft; the first shaft being inserted in the first shaft hole, and the second shaft being inserted in the second shaft hole.

5. The fan structure with non-circular circumference as claimed in claim 1, wherein a magnetic element is circumferentially provided on an inner surface of the first side wall of the first hub to be located corresponding to the stator unit.

6. The fan structure with non-circular circumference as claimed in claim 1, wherein the first hub internally defines a receiving chamber, in which the stator unit is received; and the receiving chamber being communicable with the receiving space in the frame.

7. The fan structure with non-circular circumference as claimed in claim 1, wherein the first base is provided around a lower portion with a plurality of outward extended first supporting arms, and the second base is provided around a lower portion with a plurality of outward extended second supporting arms.

8. The fan structure with non-circular circumference as claimed in claim 1, wherein the transmission belt member further has an edge portion; and the first and the second assembling member being pressed against the edge portion to prevent the transmission belt member from becoming loosened from the first and second hubs.

9. The fan structure with non-circular circumference as claimed in claim 1, wherein the frame further defines an air inlet and an air outlet; the air inlet and the air outlet being communicable with the receiving space in the frame, and the first and the second base being provided at the air outlet.

10. The fan structure with non-circular circumference as claimed in claim 1, wherein the blades are integrally formed with the transmission belt member.

11. The fan structure with non-circular circumference as claimed in claim 1, wherein the belt surface portion of the transmission belt member includes an outer surface and an inner surface; the blades being formed on the outer surface, and the inner surface being in contact with the first and the second side wall.

* * * * *